US009816412B1

(12) United States Patent
Strickland, Jr.

(10) Patent No.: US 9,816,412 B1
(45) Date of Patent: Nov. 14, 2017

(54) DUAL PURPOSE MUFFLER

(71) Applicant: Edmond Bruce Strickland, Jr., Ramer, AL (US)

(72) Inventor: Edmond Bruce Strickland, Jr., Ramer, AL (US)

( * ) Notice: Subject to any disclaimer, the term of this patent is extended or adjusted under 35 U.S.C. 154(b) by 0 days.

(21) Appl. No.: 15/180,868

(22) Filed: Jun. 13, 2016

(51) Int. Cl.
*F01N 1/24* (2006.01)
*F01N 1/00* (2006.01)

(52) U.S. Cl.
CPC ..... *F01N 1/006* (2013.01); *F01N 1/24* (2013.01); *F01N 2310/02* (2013.01); *F01N 2470/02* (2013.01)

(58) Field of Classification Search
CPC ..... F01N 1/006; F01N 1/24; F01N 2310/02; F01N 2470/02
USPC ..... 181/212, 257, 227, 228, 251
See application file for complete search history.

(56) References Cited

U.S. PATENT DOCUMENTS 2,016,254 A * 10/1935 Noblitt ..... F01N 1/00 181/251
2,624,418 A * 1/1953 Bourne ..... F01N 1/089 181/251
4,108,276 A * 8/1978 Hall ..... F01N 1/10 181/256
4,234,054 A * 11/1980 Chapin ..... F01N 1/24 181/249
4,712,644 A * 12/1987 Sun ..... F01N 1/003 181/251
5,198,625 A * 3/1993 Borla ..... F01N 1/04 181/248
6,935,461 B2 * 8/2005 Marocco ..... F01N 1/02 181/212
8,439,159 B1 * 5/2013 Borla ..... F01N 1/083 181/212
8,627,921 B2 * 1/2014 Mead ..... F01N 1/085 181/251

OTHER PUBLICATIONS http://www.aa1car.com/library/exhaust_backpressure.htm; AA1 Car. Exhaust Backpressure. n.d. web site. Oct. 14, 2015, five pages.

(Continued)

*Primary Examiner* — Forrest M Phillips
(74) *Attorney, Agent, or Firm* — Waller, Lansden Dortch & Davis, LLP; Nathan J. Bailey; Blake M. Bernard

(57) ABSTRACT

A muffler may include a main body, a perforated tube assembly disposed within the main body, inlet and outlet end cap assemblies connected to opposite ends of the main body, and inlet and outlet expansion chambers defined in opposite ends of the main body by the perforated tube assembly, the inlet and outlet end cap assemblies, and portions of the main body. The perforated tube assembly may include a plurality of perforated tubes with tube supports connected to opposite ends of the perforated tubes. Portions of each perforated tube located between the tube supports may be individually wrapped with insulating material and collectively wrapped with an additional layer of insulating material. Unwrapped portions of each perforated tube may extend into the inlet and outlet expansion chambers defined in the main body.

19 Claims, 7 Drawing Sheets

(56) References Cited

OTHER PUBLICATIONS http://www.vehicleservicepros.com/article/10334376/exhaustbackpressurechecksareessential; Vehicle Service Pros. Exhaust Backpressure Checks Are Essential. n.d. Web Site. Oct. 14, 2015; two pages.
http://www.tomorrowstechnician.com/undercover-taking-a-look-into-muffler-technology/; Carley, Larry. Taking a Look Into Muffler Technology. Aug. 31, 2006. Web Site. Oct. 14, 2015; five pages.
https://www.acoustics.asn.au/conference_proceedings/AAS2005/papers/34.pdf; Potente, Daniel. "General Design Principles of an Automotive Muffler." Proceedings of Acoustics 2005. Busselton: Australian Acoustical Society, 2005. 153-158. PDF, six pages.
http://www.nsxprime.com/nsx-faq/exhaust-theory/; Prime, NSX. Exhaust Theory. n.d. Web site. Oct. 15, 2015; five pages.
Thombare, Dhananjay. "A Practical Approach towards Muffler Design, Development, and Prototype Validation." SAE International Journal of Engines (2010): 1-16. PDF; 17 pages.

* cited by examiner

DUAL PURPOSE MUFFLER

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to mufflers.

More particularly, the present disclosure relates to a muffler that reduces noise without decreasing vehicle performance.

Mufflers are well known in the prior art. There are dissipative mufflers (commonly referred to as glass packs because of the fiberglass insulation used to make these types of mufflers), which have minimum impact on vehicle performance but are not effective at reducing vehicle noise; reactive mufflers, which are more effective at reducing vehicle noise but only at the expense of vehicle performance; and hybrid mufflers that include both dissipative and reactive features but lean toward one type of design or the other, i.e., they have more dissipative or reactive qualities with the corresponding disadvantages with regard to vehicle noise or loss in vehicle performance associated with each type of design.

What is needed, then, is a new type of muffler that more effectively reduces vehicle noise without reducing vehicle performance.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The present invention is directed to a muffler that reduces vehicle noise without reducing vehicle performance. In one embodiment, the muffler may include a main body, a perforated tube assembly inside the main body, inlet and outlet end cap assemblies connected to opposite ends of the main body, and inlet and outlet expansion chambers defined within the opposite ends of the main body by the perforated tube assembly, the inlet and outlet end cap assemblies, and portions of the main body. The perforated tube assembly may include a plurality of perforated tubes with tube supports located at opposite ends of the assembly. Portions of each perforated tube located between the tube supports may be individually wrapped with insulating material and collectively wrapped with an additional layer of insulating material. The perforated tubes may pass through the tube supports and partially extend into the inlet and outlet expansion chambers.

Numerous other objects, advantages and features of the present disclosure will be readily apparent to those of skill in the art upon a review of the following drawings and description of a preferred embodiment.

DETAILED DESCRIPTION

Figure 1:
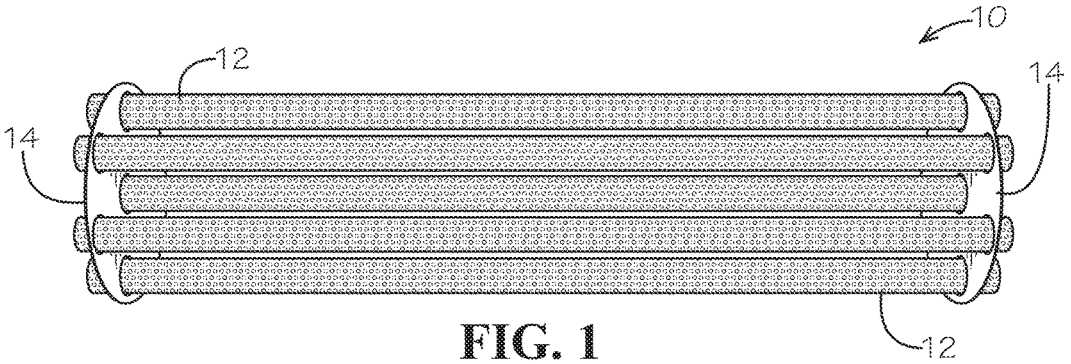
FIG. 1 is a side perspective view showing one embodiment of a perforated tube assembly included in one embodiment of the present invention.
Figure 2:
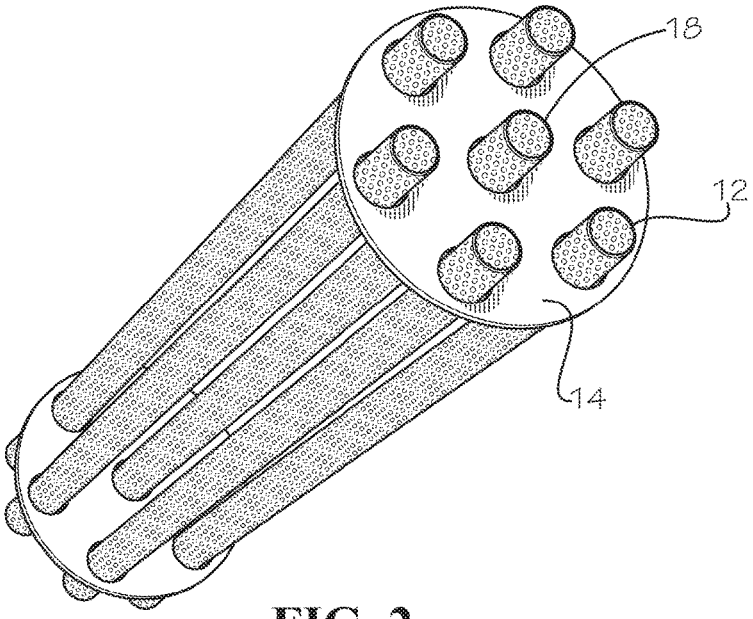
FIG. 2 is a front perspective view of the embodiment of the perforated tube assembly shown in FIG. 1.
Figure 3:
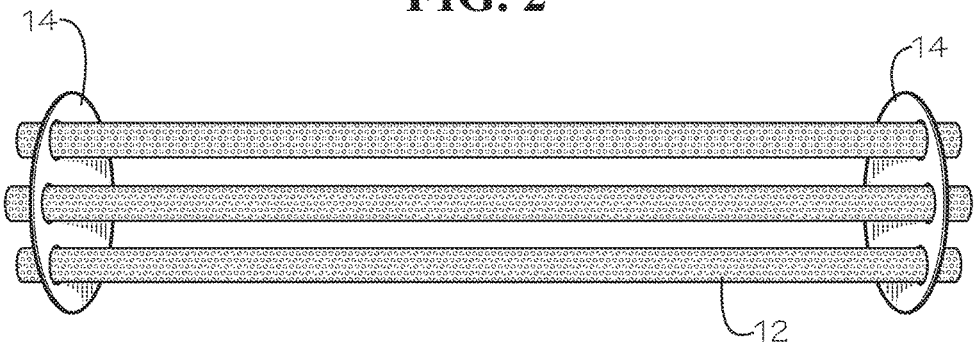
FIG. 3 is another side perspective view of the embodiment of the perforated tube assembly shown in FIG. 1.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing. A person of skill in the art will recognize that the apparatus can assume different orientations when in use.

FIGS. 1-4 show a perforated tube assembly 10 included with one embodiment of the present invention. The perforated tube assembly 10 may include a plurality of perforated tubes 12 and a pair of tube supports 14 connected to opposite ends of the plurality of perforated tubes. The tube supports 14 may be disc-shaped and include a plurality of tube openings 16 (FIG. 6), and the plurality of perforated tubes may extend partially through the plurality of tube openings. In one embodiment, as shown in FIG. 1, the perforated tube assembly may include seven (7) perforated tubes but that number may vary from one embodiment to another. The perforated tubes and tube supports, as well as the other components included in the present invention and discussed in more detail below, may be made out of 16 gauge steel or any other material suitable for use in a muffler system.

The plurality of perforated tubes may include a central perforated tube 18 with a plurality of outer perforated tubes radially positioned around the central perforated tube. The outer tubes may be evenly spaced apart from the central tube and from each other. The perforated tubes 12 may be 26 inches long and have an inner diameter of 1.15 inches. The tubes 12 may be manufactured out of perforated sheet metal from W.W. Grainger, Inc. (product number 5PDE1 in one embodiment) and fashioned into tubes using a hammer. Additional information regarding the 5PDE1 product is available at www.grainger.com/product/GRAINGER-APPROVED-Sheet-5PDE1 and that information is hereby incorporated by referenced into the present application. The perforations in the perforated metal sheets may be 0.125 inches in diameter and 40% of the surface are of each sheet may be perforated. The number and diameter of the perforations may vary from one embodiment to another.

The tube supports 14 may be manufactured out of 16 gauge steel and have diameters of 5.834 inches. The tube openings 16 may have a diameter of 1.2 inches.

Figure 5:
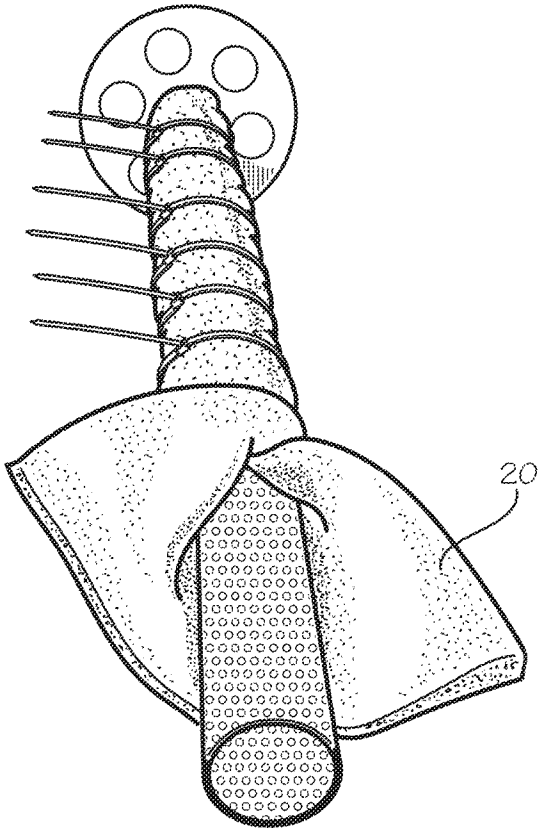
FIG. 5 is a front perspective view of one embodiment of a perforated tube included in one embodiment of the present invention.
Figure 4:
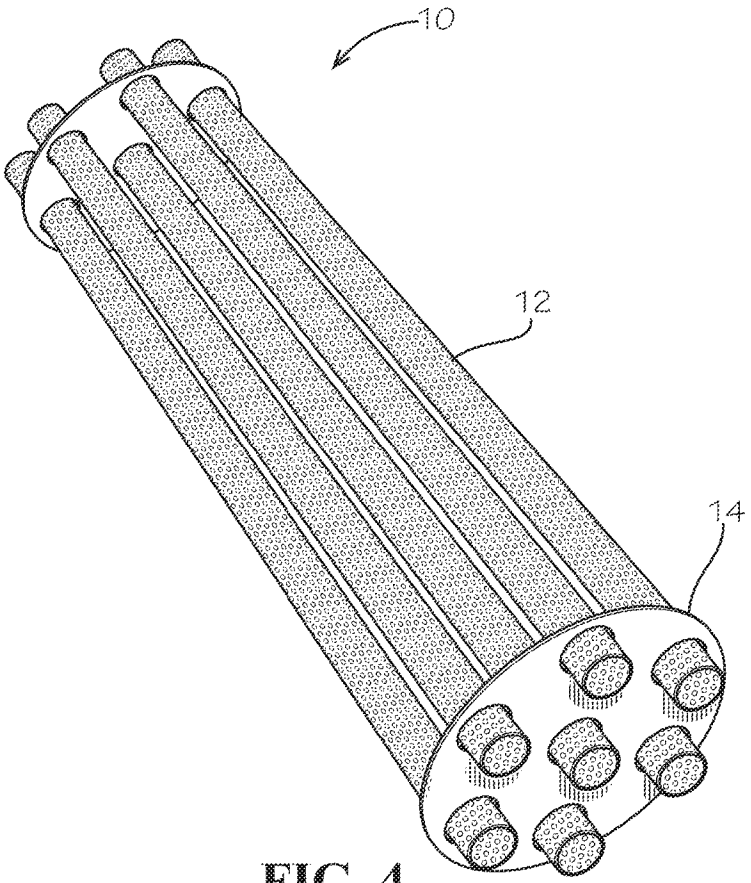
FIG. 4 is another front perspective view of the embodiment of the perforated tube assembly shown in FIG. 1.
Figure 6:
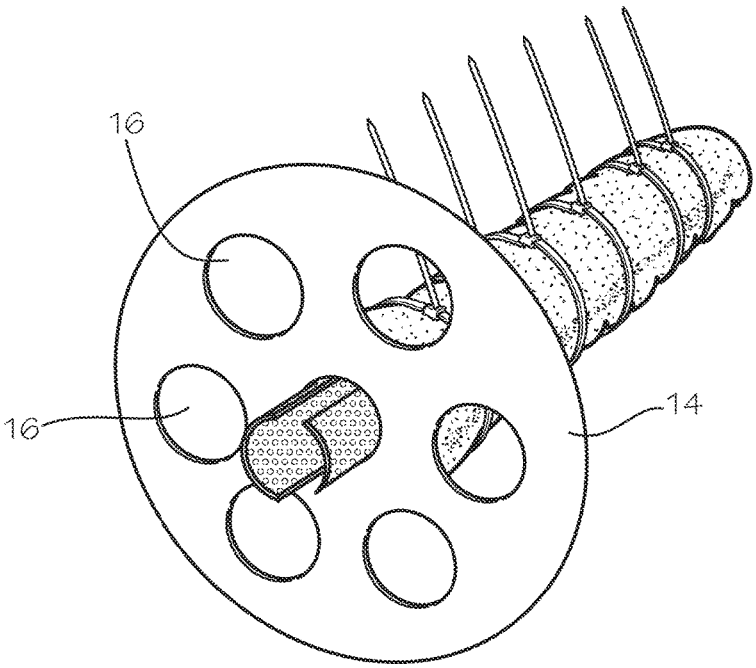
FIG. 6 is a front perspective view showing one embodiment of a tube support included in one embodiment of the present invention.
Figure 7:
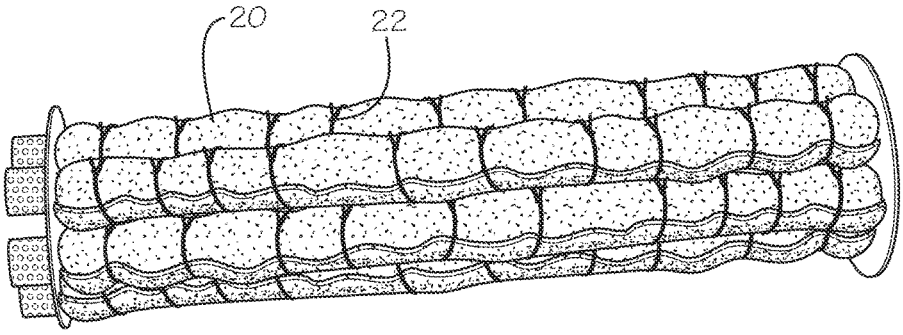
FIG. 7 is a side perspective view showing one embodiment of a perforated tube assembly included in one embodiment of the present invention with each perforated tube individually wrapped with insulating material.
Figure 10:
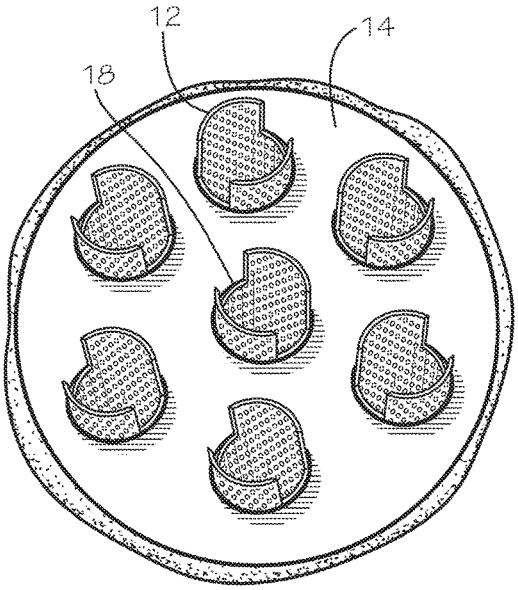
FIG. 10 is an enlarged end perspective view of the embodiment of the perforated tube assembly shown in FIG. 9.
Figure 11:
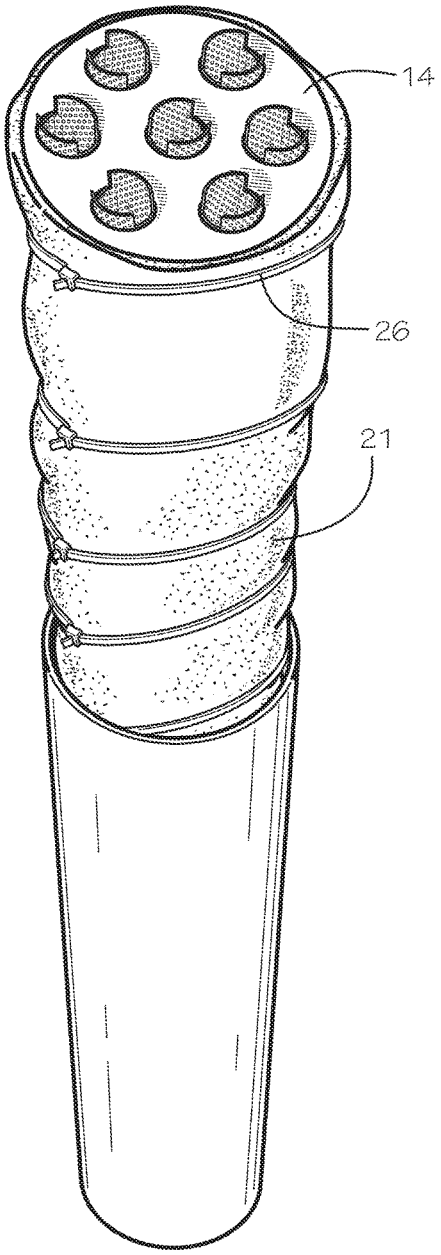
FIG. 11 is a side perspective view showing the embodiment of the perforated tube assembly shown in FIG. 9 being inserted into one embodiment of a main body included in one embodiment of the present invention.
Figure 12:
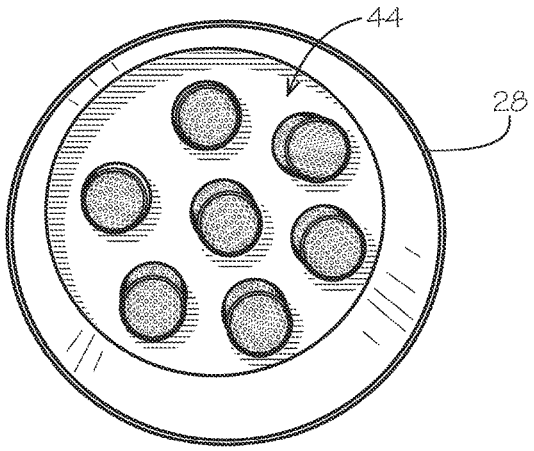
FIG. 12 is an end perspective view showing one embodiment of an expansion chamber included in one embodiment of the present invention.
Figure 13:
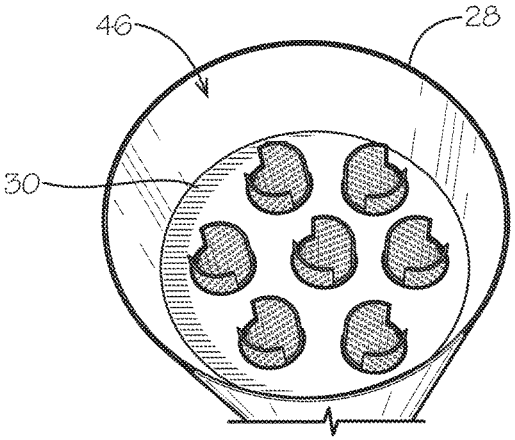
FIG. 13 is an end perspective view showing muffler sealant used with one embodiment of the present invention.
Figure 14:
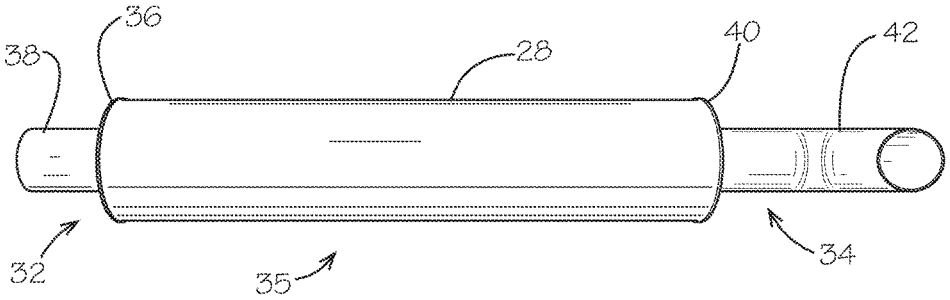
FIG. 14 is a side view showing one embodiment of the muffler of the present invention.
Figure 15:
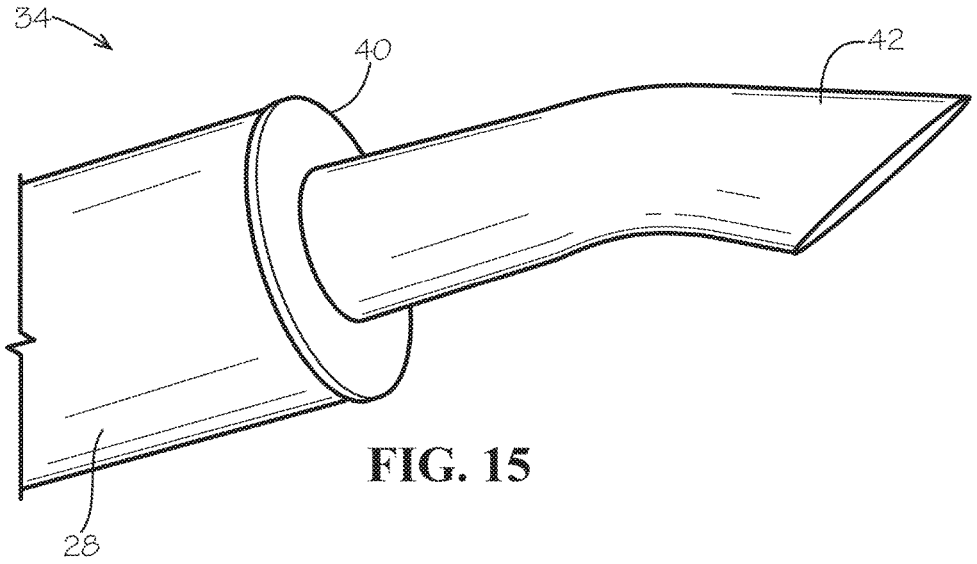
FIG. 15 is an enlarged view showing one embodiment of an outlet end cap assembly included with the embodiment of the muffler shown in FIG. 14.
Figure 16:
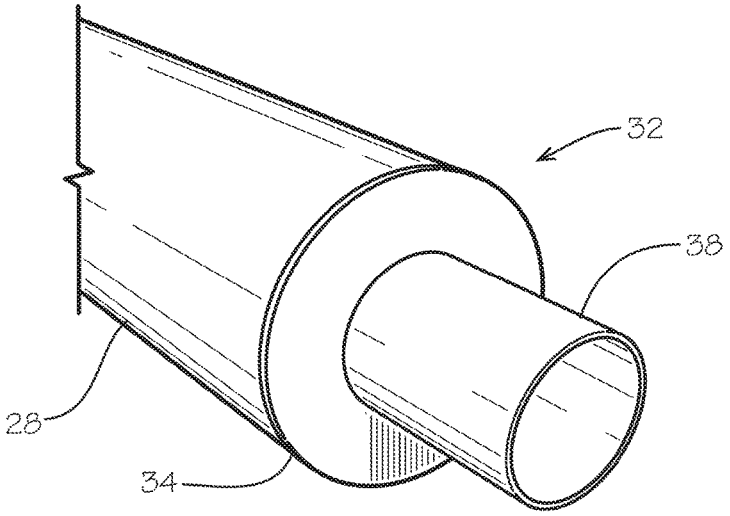
FIG. 16 is an enlarged view showing one embodiment of an inlet end cap assembly included with the embodiment of the muffler shown in FIG. 14.

Each perforated tube 12 (except for the portions extending through the tube supports) may be individually wrapped or covered with a layer of insulating material 20 (FIGS. 5 and 7), which in one embodiment may be fiberglass mat, steel wool, or some combination thereof. The insulating material may be connected to the tubes using conventional zip ties 22 in some embodiments. In other embodiments, the insulating material may be connected to the tubes using steel zip ties, string, or duct tape. The plurality of perforated tubes may be inserted partially through the tube openings defined in the tube supports and then welded to the tube supports using conventional welding techniques (FIGS. 6, 8, and 10).

Figure 8:
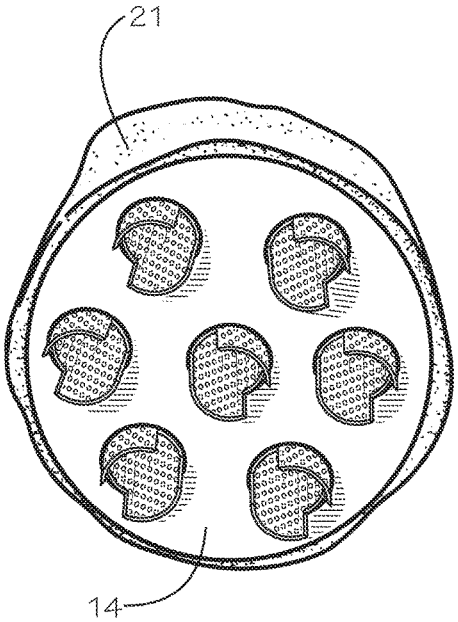
FIG. 8 is an end perspective view of the embodiment of the perforated tube assembly shown in FIG. 7.
Figure 9:
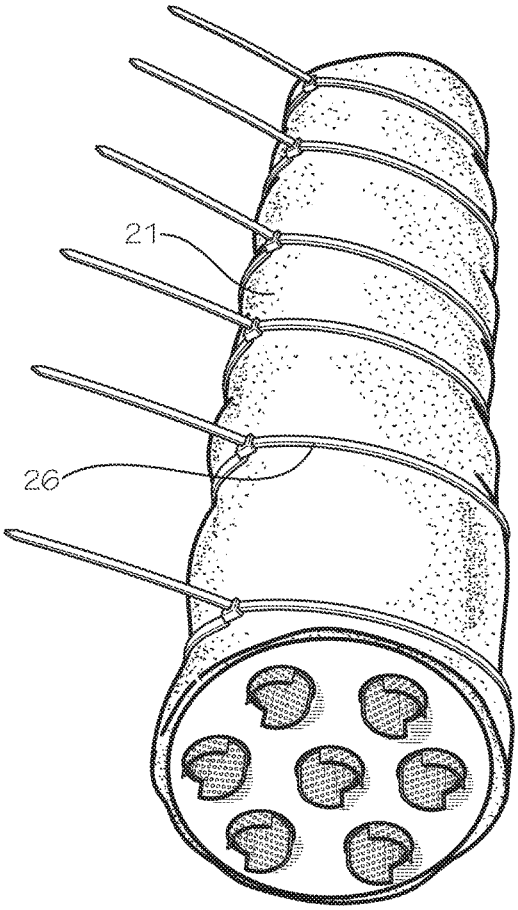
FIG. 9 is an end perspective view of the embodiment of the perforated tube assembly shown in FIG. 7 with an additional layer of insulating material wrapped around the individually wrapped perforated tubes.

Referring to FIGS. 8-9, the perforated tube assembly may include a second layer of insulating material 21 wrapped around, or covering, the plurality of insulation covered perforated tubes. Like the individual layers of insulation covering the individual perforated tubes, the second layer of insulating material 21 may be connected to the perforated tube assembly using zip ties 26. The type of insulating material may vary from one embodiment to another and, in one embodiment, includes fiberglass mat.

The perforated tube assembly 10 may be disposed within, and completely contained by, a main body 28 (FIGS. 11-16). The main body 28 may be a cylindrical tube made out of 16 gauge steel, have a diameter of 5.834 includes, and may be approximately 6 inches longer than the perforated tube assembly. The perforated tube assembly 10 may be connected to an inner surface of the main body using welding and a layer of muffler sealant 30 to ensure that the welding is substantially air tight. In some embodiments, zip ties 22 and 26 may not be used and the first and second layers of insulating material may simply be held in place by hand until the perforated tube assembly 10 is inserted into the main body 28.

Inlet and outlet end cap assemblies, 32 and 34, may be connected to opposite ends of the main body 28 to form one embodiment of the muffler 35 of the present invention. The inlet end cap assembly 32 may include an inlet end cap 36 connected to a single inlet tube 38 and may be made out of ⅛ inch steel. The outlet end cap assembly 34 may include an outlet end cap 40 connected to a single outlet tube 42 and similarly may be made out of ⅛ inch steel. The inlet and outlet ends caps, 36 and 40, along with the perforated tube assembly 10 and the main body 28, form inlet and outlet expansion chambers, 44 and 46, in opposite ends of the main body. Portions of the plurality of perforated tubes that are not wrapped or covered with insulating material may extend partially into the inlet and outlet expansion chambers, 44 and 46.

Thus, although there have been described particular embodiments of the present invention of a new and useful DUAL PURPOSE MUFFLER, it is not intended that such references be construed as limitations upon the scope of this invention.

What is claimed is:

1. A muffler, comprising:

a main cylindrical body;

a perforated tube assembly disposed within the main cylindrical body, the perforated tube assembly including a central perforated tube and a plurality of outer perforated tubes positioned radially around the central perforated tube, a portion of each of the central and outer perforated tubes individually wrapped with a respective first layer of insulating material, the perforated tube assembly collectively wrapped with a second layer of insulating material such that the second layer of insulating material is separate and independent from each respective first layer of insulating material;

a first flat, planar end cap connected to a first end of the main cylindrical body;

a second flat, planar end cap connected to a second end of the main cylindrical body;

a first substantially cylindrical expansion chamber defined between the first end cap, a first end of the perforated tube assembly, and the main body; and a second substantially cylindrical expansion chamber defined between the second end cap, a second end of the perforated tube assembly, and the main body.

2. The muffler of claim 1, wherein:

the perforated tube assembly includes a first tube support connected to the first end of the perforated tube assembly and a second tube support connected to the second end of the perforated tube assembly;

the first expansion chamber is defined between the first end cap and the first tube support; and the second expansion chamber is defined between the second end cap and the second tube support.

3. The muffler of claim 2, wherein the tube supports are substantially flat, disc-shaped, supports and include a plurality of tube openings defined therein, and each of the central perforated tube and the plurality of outer perforated tubes extend partially through corresponding tube openings in the first and second tube supports.

4. The muffler of claim 3, wherein portions of each one of the central perforated tube and the plurality of outer perforated tubes located between the first and second tube supports are individually wrapped with the corresponding first layer of insulating material.

5. The muffler of claim 4, wherein the portions of the central perforated tube and the plurality of outer perforated tubes located between the first and second tube supports are collectively wrapped with the second layer of insulating material.

6. The muffler of claim 5, wherein the first layer of insulating material and the second layer of insulating material are both fiberglass mat.

7. The muffler of claim 6, wherein the expansion chambers each have a length of approximately 3 inches.

8. A muffler, comprising:

a main body;

inlet and outlet end cap assemblies connected to opposite ends of the main body, the inlet end cap assembly including a flat, planar inlet end cap connected to a single inlet tube and one end of the main body and the outlet end cap assembly including a flat, planar outlet end cap connected to a single outlet tube and an opposite end of the main body;

a perforated tube assembly disposed in a central portion of the main body, the perforated tube assembly including a plurality of perforated tubes extending through first and second tube supports positioned at opposite ends of the perforated tube assembly so that corresponding end portions of the plurality of perforated tubes extend through the first and second tube supports, each of the plurality of perforated tubes further including an inner portion located between the first and second tube supports individually wrapped with a respective first insulating material, the inner portions of the plurality of perforated tubes collectively wrapped with a second insulating material such that the second layer of insulating material is separate and independent from each respective first layer of insulating material;

a cylindrical inlet expansion chamber defined between the inlet end cap, the first tube support, and the main body; and a cylindrical outlet expansion chamber defined between the outlet end cap, the second tube support, and the main body.

9. The muffler of claim 8, wherein the plurality of perforated tubes includes one central perforated tube and a plurality of outer perforated tubes radially positioned around the central perforated tube.

10. The muffler of claim 9, wherein the plurality of outer perforated tubes are positioned an equal distance from one another and the central perforated tube.

11. The muffler of claim 9, wherein the plurality of outer perforated tubes are evenly distributed with respect to one another and the central perforated tube.

12. The muffler of claim 9, wherein the plurality of outer perforated tubes are distributed in a circular pattern around the central perforated tube.

13. The muffler of claim 9, wherein the tube supports are substantially flat, disc-shaped, supports and include a plurality of tube openings defined therein, and the plurality of perforated tubes extend partially through the plurality of tube openings.

14. A muffler, comprising:

a main cylindrical body;

inlet and outlet end cap assemblies connected to opposite ends of the main cylindrical body, the inlet end cap assembly including a flat, planar inlet end cap having a single inlet tube connected to one end of the main cylindrical body and the outlet end cap assembly including a flat, planar outlet end cap having a single outlet tube connected to an opposite end of the main cylindrical body;

cylindrical inlet and outlet expansion chambers defined in opposite ends of the main cylindrical body adjacent to the corresponding inlet and outlet end caps; and a perforated tube assembly disposed within and connected to a central portion of the main cylindrical body, the perforated tube assembly including a plurality of perforated tubes and a pair of tube supports connected to opposite ends of the plurality of perforated tubes, each of the plurality of perforated tubes further including an inner portion located between the tube supports individually wrapped with a respective first layer of insulating material, the inner portions of the plurality of perforated tubes collectively wrapped with a second layer of insulating material such that the second layer of insulating material is separate and independent from each respective first layer of insulating material;

wherein the plurality of perforated tubes includes one central perforated tube and a plurality of outer perforated tubes radially positioned around the central perforated tube.

15. The muffler of claim 14, wherein the first layer of insulating material and the second layer of insulating material are both fiberglass mat.

16. The muffler of claim 15, wherein each one of the tube supports is substantially flat and disc-shaped and includes a plurality of tube openings defined therein.

17. The muffler of claim 16, wherein the plurality of perforated tubes pass through the plurality of tube openings defined in the pair of tub supports and extend partially into the inlet and outlet expansion chambers.

18. The muffler of claim 17, wherein the plurality of outer perforated tubes are positioned an equal distance from one another and the central perforated tube.

19. The muffler of claim 17, wherein the plurality of outer perforated tubes are evenly distributed with respect to one another and the central perforated tube.

* * * * *